US007964782B2

(12) United States Patent
Liu

(10) Patent No.: US 7,964,782 B2
(45) Date of Patent: Jun. 21, 2011

(54) METHOD FOR OPERATING CUE POINT ON LIGHTING RING OF DIGITAL MULTIMEDIA AUDIO PLAYER

(75) Inventor: Shen-Chi Liu, Tainan (TW)

(73) Assignee: Hanpin Electron Co., Ltd., Tainan County (TW)

( * ) Notice: Subject to any disclaimer, the term of this patent is extended or adjusted under 35 U.S.C. 154(b) by 54 days.

(21) Appl. No.: 12/588,701

(22) Filed: Oct. 26, 2009

(65) Prior Publication Data

US 2011/0094369 A1 Apr. 28, 2011

(51) Int. Cl.
*G10H 1/00* (2006.01)

(52) U.S. Cl. ..... 84/600; 84/601; 84/602

(58) Field of Classification Search ..... 84/600–602
See application file for complete search history.

(56) References Cited

U.S. PATENT DOCUMENTS 5,280,314 A * 1/1994 Hymes ..... 352/129
5,353,275 A * 10/1994 Almonte ..... 369/189
6,535,462 B1 * 3/2003 Liu ..... 369/4
6,541,690 B1 * 4/2003 Segers, Jr. ..... 84/605
6,576,825 B2 * 6/2003 Yamada et al. ..... 84/602
6,590,840 B2 * 7/2003 Inoue et al. ..... 369/30.27
6,689,947 B2 * 2/2004 Ludwig ..... 84/721
6,751,167 B2 * 6/2004 Yamada et al. ..... 369/30.19
6,809,247 B2 * 10/2004 Yamada et al. ..... 84/612
6,897,868 B2 * 5/2005 Cliff ..... 345/440
6,961,289 B2 * 11/2005 Liu ..... 369/4
7,115,807 B2 * 10/2006 Yamada et al. ..... 84/602
7,394,731 B2 * 7/2008 Yamada et al. ..... 369/30.27
7,514,622 B2 * 4/2009 Yoshikawa ..... 84/609
7,742,686 B2 * 6/2010 Miyashita et al. ..... 386/206
7,751,684 B2 * 7/2010 Miyashita et al. ..... 386/278
2001/0011497 A1 * 8/2001 Yamada et al. ..... 84/602
2002/0033823 A1 * 3/2002 Cliff ..... 345/440
2002/0172107 A1 * 11/2002 Yamada et al. ..... 369/30.26
2003/0193846 A1 * 10/2003 Yamada et al. ..... 369/30.1
2005/0052981 A1 * 3/2005 Shim et al. ..... 369/59.26
2005/0069285 A1 * 3/2005 Miyashita et al. ..... 386/46
2005/0069286 A1 * 3/2005 Miyashita et al. ..... 386/46
2005/0127309 A1 * 6/2005 Spencer ..... 250/557
2005/0231642 A1 * 10/2005 Roman et al. ..... 348/578
2005/0259532 A1 * 11/2005 Roman et al. ..... 369/47.1
2006/0000345 A1 * 1/2006 Yoshikawa ..... 84/616
2006/0032364 A1 * 2/2006 Ludwig ..... 84/723
2006/0181968 A1 * 8/2006 Yamada et al. ..... 369/30.26
2007/0274181 A1 * 11/2007 Yao ..... 369/47.38
2007/0280489 A1 * 12/2007 Roman et al. ..... 381/119
2008/0013756 A1 * 1/2008 Roman et al. ..... 381/119
2008/0046098 A1 * 2/2008 Corbin et al. ..... 700/1

(Continued)

*Primary Examiner* — David S. Warren
(74) *Attorney, Agent, or Firm* — Rosenberg, Klein & Lee

(57) ABSTRACT

A method for operating cue points on a lighting ring of a digital multimedia audio player is revealed. A lighting ring for showing data related to digital music playing now is disposed around a turntable of a multimedia audio player. The lighting ring is arranged with a plurality of visual markers at important cue points by DJs for producing special sound effects while one of the cue point markers is set at a position that matches DJs' operation way and this is the position of an active cue point. Thereby during operation of the multimedia audio player, the obvious markers at the cue points allow DJs to operate the device easily and conveniently. Moreover, the active cue point can be set and adjusted according to different operation ways of DJs. Thus the present invention provides DJs with an intuitive reminder and convenient operation on the vision and the operational control.

3 Claims, 4 Drawing Sheets

U.S. PATENT DOCUMENTS

2008/0110970 A1* 5/2008 Kataoka et al. ..... 235/375
2008/0148922 A1* 6/2008 Morra ..... 84/600
2008/0212437 A1* 9/2008 Kataoka et al. ..... 369/53.41
2010/0014390 A1* 1/2010 Flum ..... 369/4
2010/0216547 A1* 8/2010 Coppard et al. ..... 463/31
2010/0315268 A1* 12/2010 Ward ..... 341/22

* cited by examiner

METHOD FOR OPERATING CUE POINT ON LIGHTING RING OF DIGITAL MULTIMEDIA AUDIO PLAYER

BACKGROUND OF THE INVENTION

1. Fields of the invention

The present invention relates to a method for operating cue points on a lighting ring of a digital multimedia audio player in which a plurality of visual cue point markers are set and shown significantly for easy and convenient operation of DJs. Moreover, one of the cue point markers is set as an active cue point that is adjusted to be placed at a position that DJ used to operate. This satisfies the DJ's needs of operations. The DJ is provided with an effective intuitive reminder and convenient operation on the vision and on the operational control.

2. Descriptions of Related Art

DJs (disc jockey) always show to select and play recorded music for an audience on some special occasions where the whole world floats on the air of festivity, such as concerts, parties or pubs. In order to make people have a light mood, DJ may control and rotate analogue records manually. Due to different rotation direction and rotation speed of the analogue records, various special sound effects are created. DJs always labeled some stickers on specific cue points of the analog record and each cue point is the starting point (time) of a specific song so as to make them access different songs on the record easily while they are scratching by moving the record back and forth. When the analog record is set on a turntable, a cue point labeled with the sticker is aimed at a stylus. While performing scratching, the DJ rotates the turntable counter-clockwise quickly to bring the record back to the position of the cue point. When the DJ stops moving the turntable with his hands, the record is played and moving forth on the turntable on a normal way. The positioned played is away from the original starting point (cue point) and now the turntable needs to be moved by hand, let the record back to the original position.

However, these conventional analog records include only limited number of songs in each piece so that DJs need to carry a large amount of records for preparing a wide range of music for that amount of time. The conventional records occupy a certain volume so that they are heavy, large, and inconvenient to carry.

Thus digital media such as audio players that simulate various special sound effects of the analog records have been developed. The digital media includes different forms of music such as CD or MP3 and various storage peripherals such as SDHC (Secure Digital High Capacity) memory cards, etc. The music players have evolved from monochrome phonographs to multimedia platform such as CD players. However, not the whole song is applied or modified with special sound effects, only at certain segments. Thus DJs usually mark the analog record at the positions desired to hit the cue point they want. Thus when the turntable rotates to the positions with marks, DJs know to spin. While playing digital music, there is no way to know the positions of the certain segment and it's difficult to mark the digital music. Yet the DJ needs to be alert to the playing music for producing special effects at the proper times. This is with much trouble and inconvenience for the DJs to find out the segments immediately for producing special effects. There is a need to improve the device.

SUMMARY OF THE INVENTION

Therefore it is a primary object of the present invention to provide a method for operating cue points on a lighting ring of a digital multimedia audio player. A lighting ring is disposed around a turntable of a multimedia audio player for showing information of the digital music playing now. The lighting ring is set with a plurality of visual markers at important cue points by DJs for producing special sound effects and one of the markers at cue points is set at a position that matches DJs' requirements of operation such as a twelve o'clock position, a six o'clock position, etc. This is the position of an active cue point. Thereby during operation of the multimedia audio player, the markers at the cue points provide DJs easy and convenient operation. Moreover, the active cue point is set and adjusted according to different operation ways of the DJs. DJs are provided with an intuitive reminder and convenient operation on the vision and the operational control. Thus the present invention is of more practical value.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
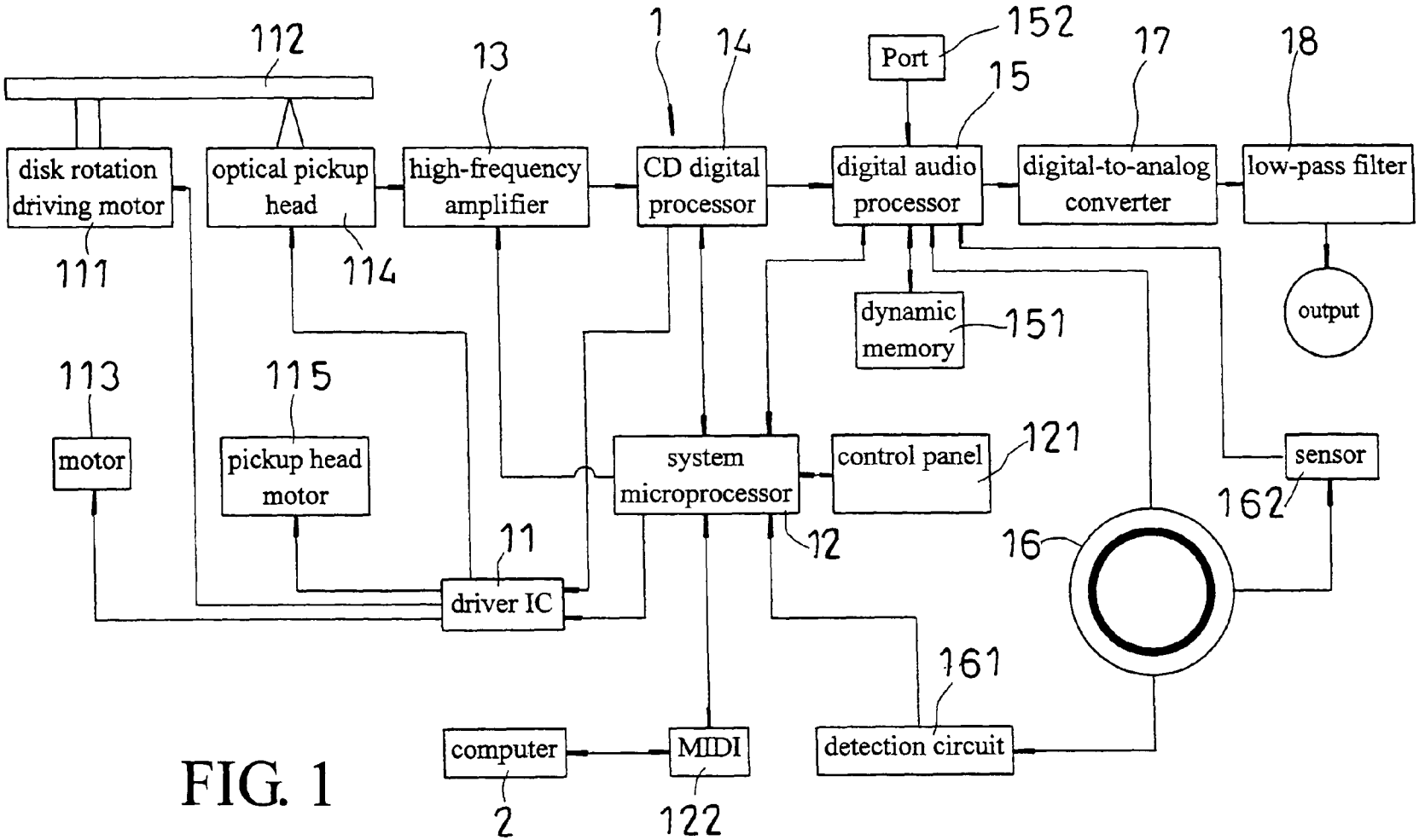
FIG. 1 is a block diagram of an embodiment according to the present invention.
Figure 2:
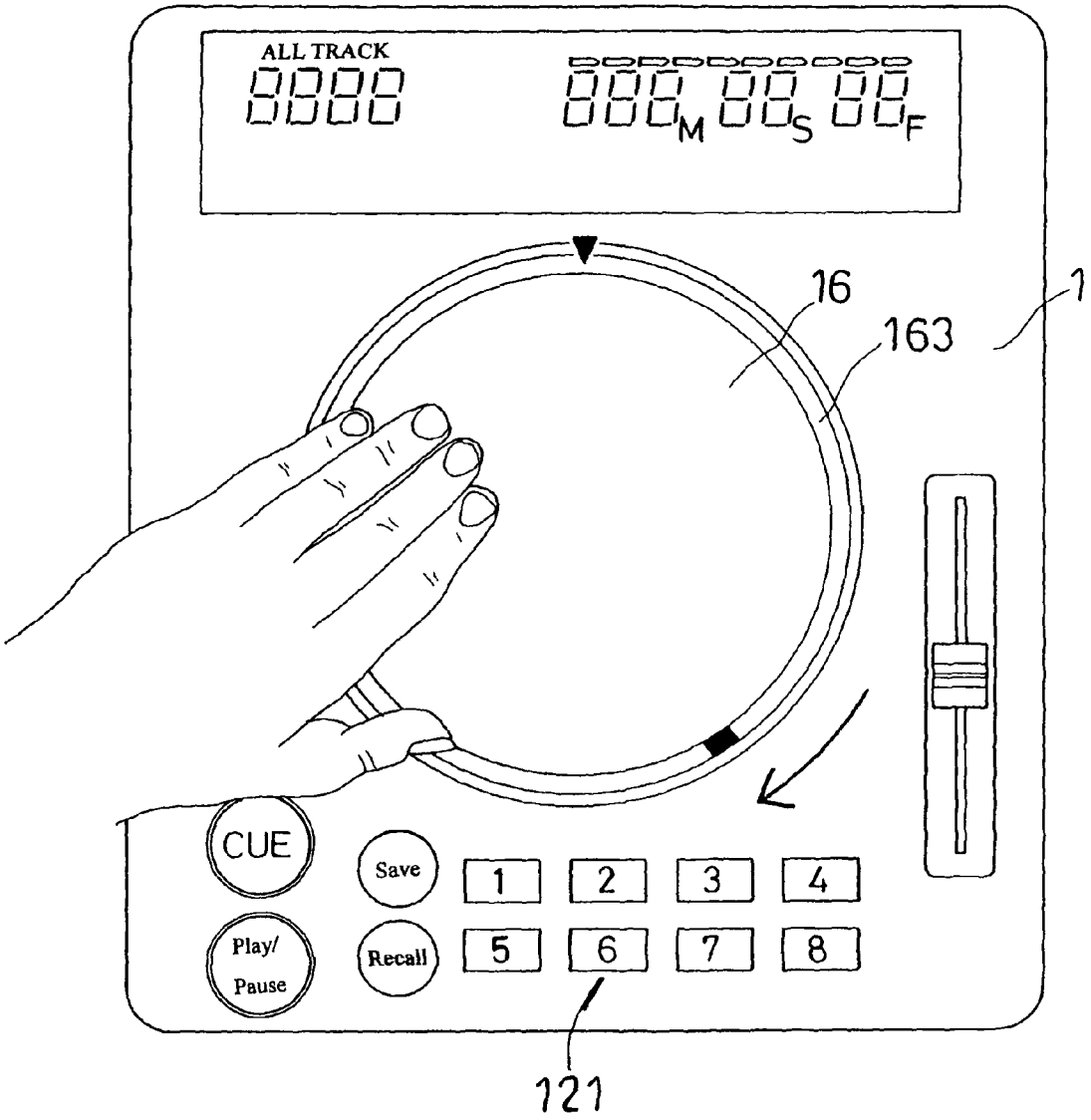
FIG. 2 is a perspective view of an embodiment according to the present invention.

Refer to FIG. 1 and FIG. 2, a multimedia audio player 1 of the present invention includes a record base 112 for loading CD (compact disk) records and driven by a disk rotation driving motor 111 that is controlled by a driver IC (integrated circuit) 11. The disk loading of the record base 112 is controlled by a motor 113 which is also controlled by the driver IC 11. When a system microprocessor 12 starts running, it controls a high-frequency amplifier 13 to turn on a laser light as well as a CD digital processor 14 to initiate an optical pickup head 114 through the driver IC 11. The optical pickup head 114 is moved and controlled by a pickup head motor 115, and is sending signals to the CD digital processor 14 through the a high-frequency amplifier 13 so as to initiate the disk rotation driving motor 111 for making the CD record loaded on the record base 112 rotate at two times speed. Then the optical pickup head 114 reads music data recorded on the CD record and sends the data to the system microprocessor 12 and a digital audio processor 15 through the high-frequency amplifier 13 and the CD digital processor 14 and messages of the CD record is shown on a control panel 121 while the music recorded on the CD is stored in a dynamic memory 151. Moreover, the digital audio processor 15 is connected with a port such a USB port, SDHC port, etc. for connecting and inputting other digital music data. Messages related to the digital music data input through the port 152 are also displayed on the control panel 121 and stored in the dynamic memory 151.

Furthermore, the system microprocessor 12 connects with a musical instrument digital interface (MIDI) 122 that is connected to a computer 2 for the purpose of control. The present invention further includes a turntable 16 that is connected with a detection circuit 161 so that the system microprocessor 12 can check whether a contact is a body contact. Once the DJ applies a certain force to rotate the turntable 16, a light sensor 162 disposed on the turntable 16 detects the rotation speed and rotation direction immediately to make the digital audio processor 15 process and retrieve the music in the dynamic memory 151 according to the detected results. The song, speed and forward/reverse direction of the music data are converted into analog signals by a digital-to-analog converter (DAC) 17, filtered by a low-pass filter 18, and then to be played.

Figure 3:
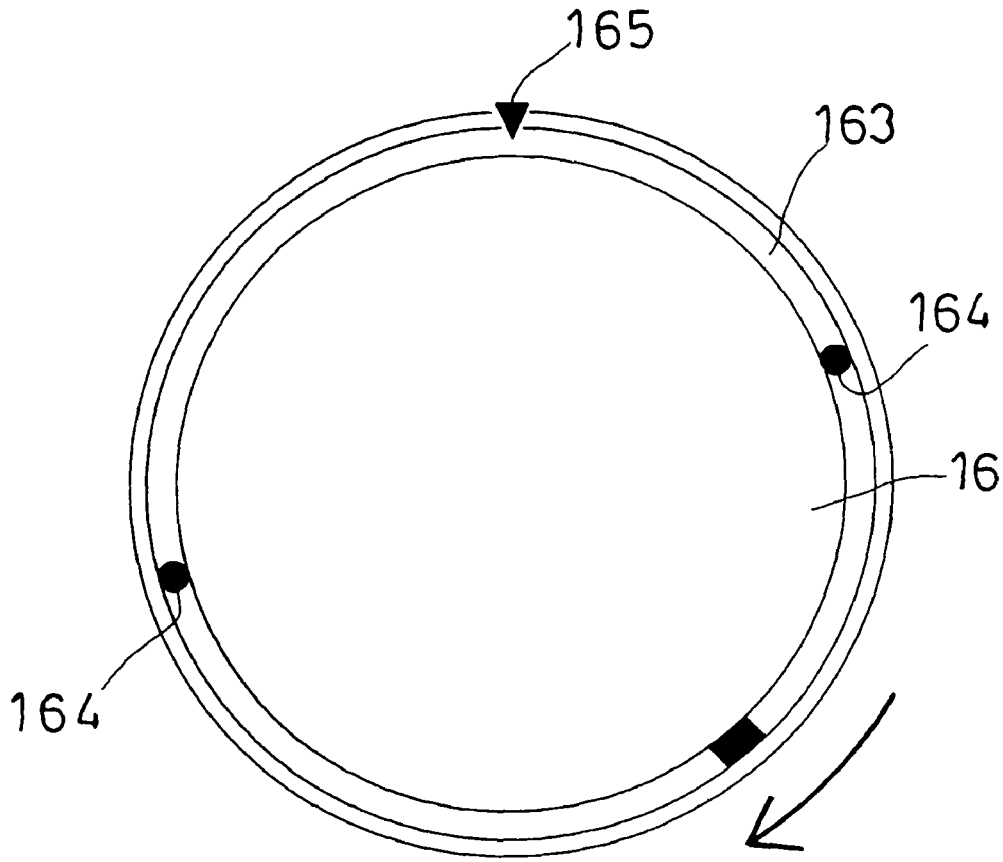
FIG. 3 is a schematic drawing showing a setting of an embodiment according to the present invention.

In addition, a lighting ring 163 for showing corresponding digital music data playing now is disposed around the turntable 16. Several markers are set at cue points of the music playing now by the DJ for producing special sound effects, as shown in FIG. 3.

Thereby after the music data input the multimedia audio player 1 being processed by the digital audio processor 15, information related to the digital music playing now is shown on the lighting ring 163 around the turntable 16. The lighting ring 163 allows DJ to specify the music playing now with several markers at cue points set through the control panel 121 or software in the computer 2. The lighting ring 163 is set up with a plurality of cue point markers 164 that are represented by different colors. For example, the red color represents the first cue point marker 164, the orange color represents the second cue point marker 164, the yellow color represents the third cue point marker 164, and so on. Moreover, the light intensity of each cue point marker 164 depends on the time interval between the time of the music to be played and this moment.

Figure 4:
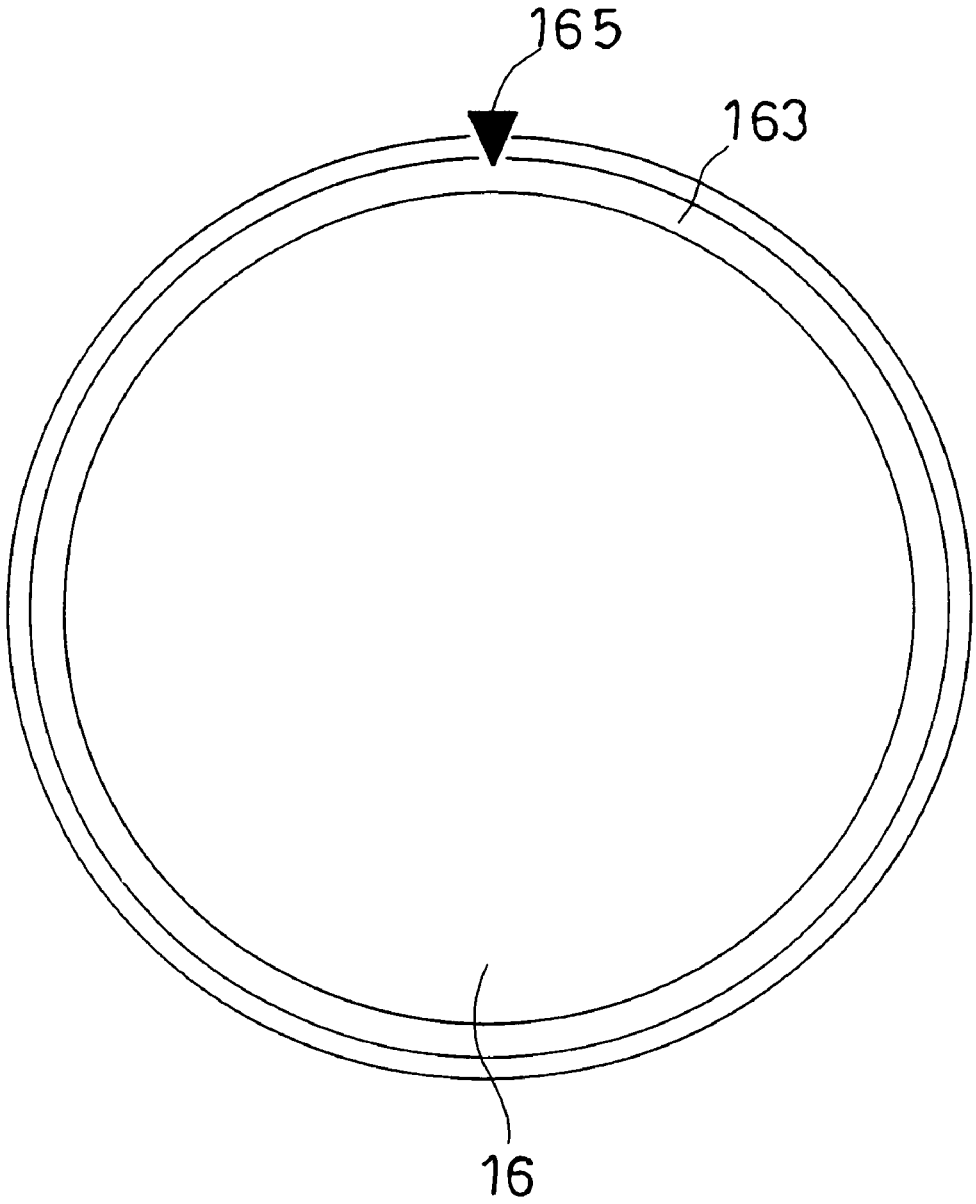
FIG. 4 is a schematic drawing showing an adjustment of an embodiment according to the present invention.

Because the setting and display of the cue point markers 164 are according to time of the music data, the positions of the cue point markers 164 on the lighting ring 163 are not adapted well to the DJ's needs of operations. Thus the DJ can make some adjustments. For example, one of the cue point markers 164 is set as an active cue point 165 (the cue point in execution), placed at a position that DJ used to operate such as a twelve o'clock position, as shown in FIG. 4. According to the music data sent from the digital audio processor 15, the system microprocessor 12 compares data of the active cue point 165 and the data at the twelve o'clock position of the lighting ring 163 for obtaining a time difference therebetween so as to shift the cue point markers 164 shown on the lighting ring 163 and the active cue point 165 is shown on the position that matches DJ's needs. The shift of the position of the active cue point 165 has no influence on the time data. For example, the time data of the active cue point 165 is 2'25"36 frame, and the DJ has set the position of the active cue point 165 at the twelve o'clock position. When the DJ turns on the device, the time data at the twelve o'clock position of the lighting ring 163 is 2'25"36 frame while other positions have the same time shift correspondingly.

Moreover, the present invention also provides a reminding function. When the DJ operates the device, the music keeps playing and the time displaying now is away from the active cue point 165. In order to assist the DJ in access to the active cue point 165, the reminding function is designed. While accessing the active cue point 165, the light color or the flicker frequency is changed to remind the DJ. For example, the time data of the active cue point 165 is 2'25"36 frame and the position of the active cue point 165 is set at the twelve o'clock position by the DJ. Once the DJ turns on the device, the time data of the position at the twelve o'clock position is 2'25"36 frame. When the music continues to play and the time is 2'30 15 frame, if the DJ wants to turn back the active cue point 165 and rotates the turntable counterclockwise to access the active cue point 165, the light color or the flicker frequency of the color active cue point 165 is going to change for reminding.

In summary, compared with the structure available now, the present invention has following advantages:

1. The lighting ring of the present invention is disposed around the turntable so that the plurality of cue point markers labeled thereof is significant and obvious. Thus the DJ can operate the device easily and conveniently and the present invention is of more practical value.
2. In the present invention, the turntable is labeled with a plurality markers of cue points in which one cue point marker is set as an active cue point on a position that satisfies the DJ's needs of operations. Either on the vision or on the operational control, the DJ is provided with an intuitive reminder and convenient operation.
3. The cue point markers on the turntable are differentiated by colors. Similarly, this makes the operation become more convenient and efficient.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A method for operating cue points on a lighting ring of a digital multimedia audio player comprising the steps of:

disposing a turntable with a lighting ring around; showing digital music data playing now on the lighting ring;

arranging a plurality of visual cue point markers at the lighting ring for producing special sound effects of the music data playing now;

adjusting and setting one of the cue point markers as an active cue point at a position that matches users' requirements of operation; and comparing the music data of the active cue point with the data at the adjusted position of the lighting ring for getting a time difference therebetween so as to shift the cue point markers shown on the lighting ring and the active cue point is just at the adjusted position.

2. The method as claimed in claim 1, wherein the plurality of cue point markers disposed on the lighting ring are represented and differentiated by different colors.

3. The method as claimed in claim 1, wherein the multimedia audio player is connected with a musical instrument digital interface (MIDI) and a computer is coupled with the MIDI for control of the MIDI.

* * * * *